US010429131B2

(12) United States Patent
Nikolic et al.

(10) Patent No.: US 10,429,131 B2
(45) Date of Patent: Oct. 1, 2019

(54) METHOD AND ARRANGEMENT FOR PREVENTING GAS FROM LEAVING AN OPENING OF A VESSEL

(71) Applicant: Glencore Technology Pty Limited, Brisbane (AU)

(72) Inventors: Stanko Nikolic, Brisbane (AU); Stephen Francis Gwynn-Jones, Brisbane (AU); Nathan Roy Woodall, Brisbane (AU)

(73) Assignee: Glencore Technology Pty Limited, Brisbane (AU)

( * ) Notice: Subject to any disclaimer, the term of this patent is extended or adjusted under 35 U.S.C. 154(b) by 399 days.

(21) Appl. No.: 15/311,952

(22) PCT Filed: May 21, 2015

(86) PCT No.: PCT/AU2015/050262
§ 371 (c)(1),
(2) Date: Nov. 17, 2016

(87) PCT Pub. No.: WO2015/176131
PCT Pub. Date: Nov. 26, 2015

(65) Prior Publication Data

US 2017/0097192 A1 Apr. 6, 2017

(30) Foreign Application Priority Data

May 21, 2014 (AU) ..... 2014901896

(51) Int. Cl.
*F27D 17/00* (2006.01)
*F27D 21/00* (2006.01)
(Continued)

(52) U.S. Cl.
CPC ..... *F27D 21/00* (2013.01); *F27D 3/16* (2013.01); *F27D 17/003* (2013.01);
(Continued)

(58) Field of Classification Search
CPC ..... F27D 3/1545; F27D 3/16; F27D 99/0073; F27D 17/003; F27D 21/00;
(Continued)

(56) References Cited

U.S. PATENT DOCUMENTS 1,393,749 A 10/1921 Carstens
3,198,623 A 8/1965 Evans et al.
(Continued)

FOREIGN PATENT DOCUMENTS

CA 1250427 A 2/1989
DE 4014693 A1 11/1991
EP 1055092 A1 11/2000

OTHER PUBLICATIONS

Fernando, Pathma, "International Search Report," prepared for PCT/AU2015/050262, dated Aug. 4, 2015, four pages.

*Primary Examiner* — Hung D Nguyen
(74) *Attorney, Agent, or Firm* — Winstead PC

(57) ABSTRACT

An arrangement (10) for preventing egress of a gas from a first opening of a vessel, the vessel including at least one other opening through which the gas can leave the vessel, the arrangement comprising an open passage (48) extending substantially around the first opening, the open passage (48) receiving a flow of gas such that the flow of gas leaves the open passage and flows towards and into the vessel to cause a gas from the environment external to the vessel to be drawn into the vessel. The arrangement may comprise a Coanda surface. The arrangement may be in the form of an inert for placement in the opening to the furnace.

20 Claims, 9 Drawing Sheets

(51) Int. Cl.

| | |
|---|---|
| ***F27D 3/16*** | (2006.01) |
| ***F27D 99/00*** | (2010.01) |
| *C21C 5/46* | (2006.01) |
| *C21C 7/10* | (2006.01) |

(52) U.S. Cl.
CPC ..... *F27D 99/0073* (2013.01); *C21C 5/46* (2013.01); *C21C 7/10* (2013.01); *F27D 2021/0078* (2013.01)

(58) Field of Classification Search
CPC ... F27D 2021/0078; C21C 5/305; C21C 5/40; C21C 5/42; C21C 5/46; C21C 5/52; C21C 5/5217; C21C 5/5294; C21C 5/565; C21C 7/10; F27B 3/085; F27B 3/10; F27B 3/12; F27B 3/24; F27B 3/28; F27B 1/10; F27B 1/20
USPC ..... 373/8, 9, 79, 80, 81, 82, 85
See application file for complete search history.

(56) References Cited

U.S. PATENT DOCUMENTS

| | | | | |
|---|---|---|---|---|
| 4,138,098 | A | 2/1979 | Leroy | |
| 4,210,315 | A * | 7/1980 | Lilja | B01F 3/06 373/81 |
| 4,437,186 | A * | 3/1984 | Inai | C21C 5/565 373/80 |
| 4,648,584 | A * | 3/1987 | Wamser | C21C 5/52 373/8 |
| 5,787,108 | A * | 7/1998 | Pavlicevic | F27D 17/003 373/8 |
| 6,003,879 | A | 12/1999 | Grewal | |
| 6,219,371 | B1 * | 4/2001 | Pavlicevic | F27B 3/24 373/9 |
| 2015/0267271 | A1 * | 9/2015 | Brotzmann | C21C 5/565 373/80 |

* cited by examiner

METHOD AND ARRANGEMENT FOR PREVENTING GAS FROM LEAVING AN OPENING OF A VESSEL

TECHNICAL FIELD

The present invention relates to a method and an arrangement for preventing egress of gas from a first opening of the vessel.

BACKGROUND ART

Furnaces are used in a wide range of metallurgical processes. Many furnaces include a first opening through which feed materials can be fed to the furnace and a second opening through which an exhaust gas or flue gas can be removed from the furnace, as well as other openings for final products and by-products to be recovered. Typical materials that are fed to furnaces in metallurgical processes include concentrates or ores, fluxes, fuel such as coal or coke, and air or oxygen. The feed materials undergo reaction with the contents of the furnace to produce desirable metallurgical products. Exhaust gases are produced during the process and the exhaust gases are removed through the exhaust outlet of the furnace. Dust generated from the feed material descending in the furnace can also find its way passing with the exhaust gases and removed through the exhaust outlet.

One type of furnace that is finding increased use in metallurgical processing is the top entry submerged lance furnace. Top entry submerged lance furnaces comprised a furnace body or vessel. A feed opening is provided in the top of the furnace. An exhaust opening is provided laterally of the feed opening. Furnace feed material is passed to the furnace through the feed opening. A lance is inserted through a separate opening into the furnace. A gas and, optionally, a fuel, are passed through the lance into the furnace. The tip of the lance extends into the molten contents of the furnace. Injection of gas through the lance agitates the molten contents of the furnace and promotes the metallurgical reactions. The exhaust gases produced by the metallurgical process exit the furnace through the exhaust opening. One type of top entry submerged lance furnace is sole by the present applicant under the ISASMELT™ trade mark.

Operating personnel are frequently required to be physically present close to the feed opening of the furnace. Therefore, it is desirable that gases or dust from the furnace do not exit the furnace through the feed opening. However, in practice, it can be difficult to prevent furnace gases or dust exiting through the feed opening.

It will be clearly understood that, if a prior art publication is referred to herein, this reference does not constitute an admission that the publication forms part of the common general knowledge in the art in Australia or in any other country.

SUMMARY OF INVENTION

The present invention is directed to a method for preventing egress of gas from an opening in a vessel and to an arrangement for preventing egress of gas from an opening in a vessel which may at least partially overcome at least one of the abovementioned disadvantages or provide the consumer with a useful or commercial choice.

In one aspect, the present invention provides a method for preventing egress of gas from a first opening of a vessel, the vessel including at least one other opening through which the gas can leave the vessel, the method comprising supplying a flow of gas to an open passage extending substantially around the first opening and causing the flow of gas leaving the open passage to flow towards and into the vessel whereby a gas from an environment external to the vessel is caused to be drawn into the vessel, wherein a total flow of gas into the first opening substantially prevents gas from leaving the vessel through the first opening.

In a second aspect, the present invention provides an arrangement for preventing egress of a gas from a first opening of a vessel, the vessel including at least one other opening through which the gas can leave the vessel, the arrangement comprising an open passage extending substantially around the first opening, the open passage receiving a flow of gas such that the flow of gas leaves the open passage and flows towards and into the vessel to cause a gas from the environment external to the vessel to be drawn into the vessel.

In some embodiments, the open passage extends around the first opening. Throughout this specification, the term "open passage extending substantially around the first opening" should be considered to include a single passage extending around the first opening, a single passage extending almost completely around the first opening and a plurality of separate passages having ends that are closely spaced to an end of an adjacent passage such that gas leaving the separate passages causes an inflow of gas that flows inwardly across the circumferential or peripheral extent of the first opening.

In one embodiment, the first opening comprises a generally circular opening. The open passage may comprise an annular open passage extending around the first opening. However, the present invention can be modified to suit any shaped first opening.

In one embodiment, the open passage extends around an inner surface of the first opening.

The surface of the first opening between the open passage and the vessel may be shaped to promote the flow of gas leaving the open passage to flow towards and into the vessel. In one embodiment, the surface of the first opening between the open passage and the vessel may have a shape, when moving in a direction towards the vessel, that extends inwardly towards the centre of the first opening and then outwardly away from the centre of the first opening.

In one embodiment, the surface of the first opening between the open passage and the vessel may form a venturi.

In one embodiment, the surface of the first opening between the open passage and the vessel comprises a Coanda surface.

In some embodiments, the open passage is in fluid communication with a plenum chamber. The plenum chamber may extend around the first opening. The plenum chamber receives pressurised gas. The pressurised gas flows from the plenum chamber through the open passage and into the vessel.

The plenum chamber may have at least one, preferably two or more, inlets for receiving pressurised gas. In embodiments where the plenum chamber has two or more inlets for receiving pressurised gas, the two or more inlets are preferably equi-spaced around the plenum chamber.

The vessel may comprise any vessel that has a first opening and at least one other opening through which gas can leave the vessel. The vessel may comprise a process vessel or a storage vessel. The vessel may comprise a high-temperature vessel. The vessel may comprise a furnace. The vessel may comprise a top entry submerged lance furnace.

The arrangement may further comprise a feed chute for feeding material to the vessel. The material that is fed to the vessel may comprise particulate material. The feed chute may also allow a lance to be inserted therethrough to enable the lance to be inserted into the vessel.

The particulate material that is fed to the vessel may be selected from concentrate, sand, rocks, aggregates, coal, coke, industrial minerals, limestone, cement, fluxes, man-made materials such as super phosphate, fertilizers, pharmaceuticals, foodstuffs, chemicals, and other natural materials or natural materials such as cereals such as wheat, barley, rice, oats, corn etc.

In some embodiments, the arrangement of the present invention comprises an insert that is inserted into the first opening of the vessel. When the insert is inserted into the first opening, the inner surface of the insert effectively defines the first opening of the furnace.

In one embodiment, the insert includes a portion extending into the first opening of the vessel and another portion that defines the open passage extending around an inner periphery of the insert. The insert may also define the plenum chamber and the at least one inlet for receiving pressurised gas. The insert may comprise a flange that comes into contact with an outer surface around the first opening of the vessel to thereby position the insert relative to the first opening of the vessel.

The arrangement in accordance with the present invention may be used to prevent egress of furnace contents from a number of furnace openings. For example, if a furnace is provided with two openings (such as a feed opening and a separate lance opening), each of the openings may be provided with their own arrangement in accordance with the present invention. In this manner, the arrangement provided in each opening may prevent egress of furnace contents from each opening. The skilled person will appreciate that the furnace will also include an exhaust system and exhaust gases will be removed from the furnace through the exhaust system. The exhaust system will typically include an exhaust opening and appropriate ducting/pipework. It is also possible that an arrangement in accordance with the present invention may be provided to only one of the plurality of openings to the furnace. Other openings of the furnace may be provided with conventional extraction equipment to prevent furnace contents coming into contact with operators. For example, the feed opening may be provided with an arrangement in accordance with the invention and the lance opening may be provided with conventional extraction equipment.

The furnace may have even more openings. The skilled person may choose to have only one of the openings to the furnace fitted with the arrangement in accordance with the present invention for preventing egress of furnace contents from that one opening, with other openings to the furnace thing fitted with conventional extraction equipment. Alternatively, the skilled person may choose to have two or more, or even all of the openings to the furnace (excluding the exhaust opening) fitted with the arrangement of the present invention for preventing egress of furnace contents from those openings.

Any of the features described herein can be combined in any combination with any one or more of the other features described herein within the scope of the invention.

BRIEF DESCRIPTION OF DRAWINGS

Various embodiments of the invention will be described with reference to the following drawings, in which.

DESCRIPTION OF EMBODIMENTS

The person skilled in the art will appreciate that the attached drawings have been provided for the purposes of illustrating preferred embodiments of the present invention. Therefore, it will be understood that the present invention should not be considered to be limited solely to the features as shown in the attached drawings.

The arrangement for preventing egress of gas from a vessel as shown in the attached drawings is designed to be used in the feed opening of a top entry submerged lance furnace. The feed opening of a top entry submerged lance furnace is in the top surface of the furnace. In this embodiment, pressurised gas passes through an annular open passage extending around an insert arrangement that, when inserted into the feed opening, effectively forms the feed opening of the furnace. The gas leaving the annular passageway moves downward into the vessel and causes gas from the environment external to the vessel to also flow into the vessel. The gas leaving the annular passage comprises a gas stream having a relatively low (volumetric) flow rate but having a relatively high speed. The combination of the injected gas and the entrained gas from the external atmosphere causes a total flow of gas into the feed opening of the furnace that is sufficient to prevent gas within the furnace from exiting the furnace through the feed opening.

The arrangement 10 shown in the attached figures is designed as an insert that is inserted into the feed opening of a furnace. The feed opening is typically a generally circular or oval inlet or port. The insert 10 includes a lower cylindrical projection 12 that is sized to fit snugly into the feed opening of the furnace. A flange 14 extends around the outer surface of the insert 10 above the lower cylindrical projection 12. When the lower cylindrical projection 12 of the insert 10 is inserted into the feed opening, the flange 14 rests on the top surface of the furnace surrounding the feed opening. This acts to position the insert 10 relative to the feed opening. Other arrangements may be used to position the insert relative to the feed opening.

Figure 1:
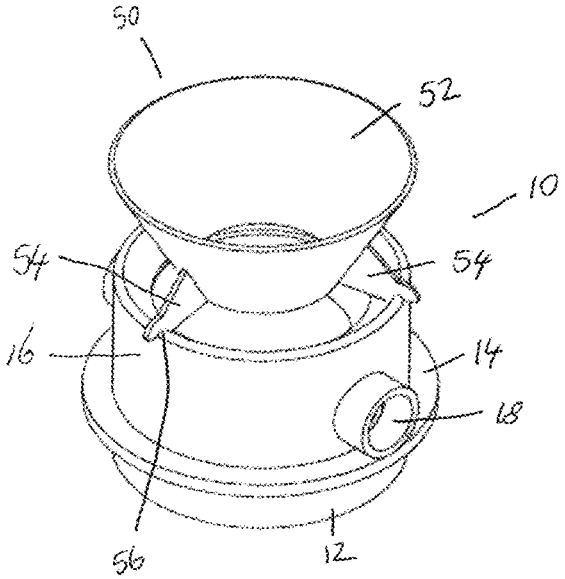
FIG. 1 shows a perspective view from above of an arrangement in accordance with one embodiment of the present invention.
Figure 2:
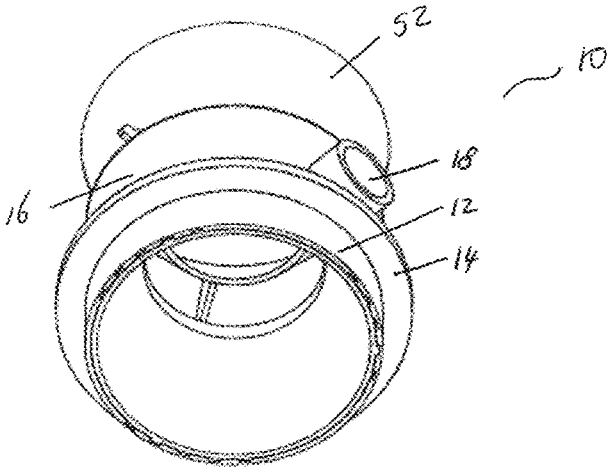
FIG. 2 shows a perspective view from below of the arrangement shown in FIG. 1.
Figure 3:
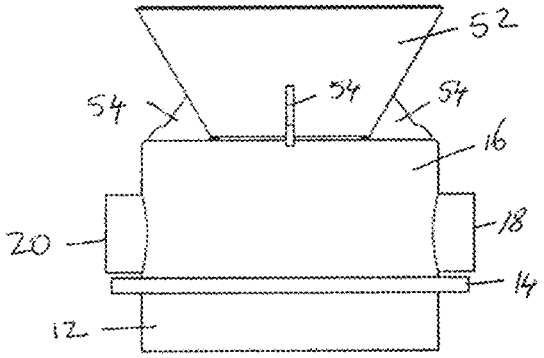
FIG. 3 shows a side view of the arrangement shown in FIG. 1.
Figure 4:
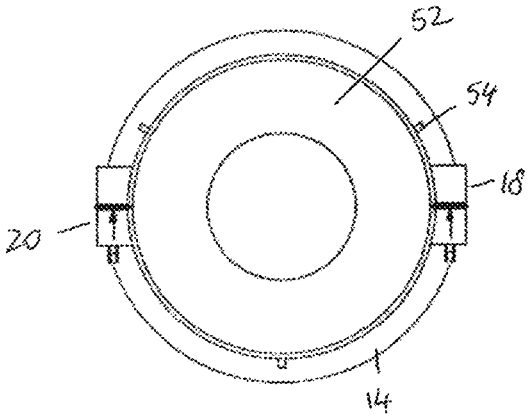
FIG. 4 shows a plan view of the arrangement shown in FIG. 1.

A generally cylindrical body portion 16 extends above the flange 14. The cylindrical body portion has two tubular openings 18, 20 (shown on FIG. 3). Openings 18, 20 can be connected to a source of pressurised gas. Openings 18, 20 may be connected to supply pipes or lines that provide pressurised gas to the insert 10. The source of pressurised gas may be any convenient source. The pressurised gas may be provided by a blower or a compressor.

Figure 6:
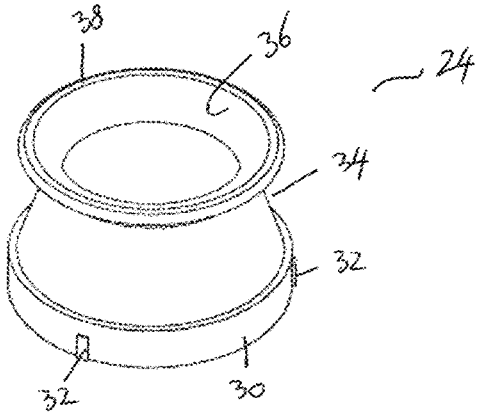
FIG. 6 shows a perspective view of an inner part of the arrangement shown in FIG. 1.
Figure 7:
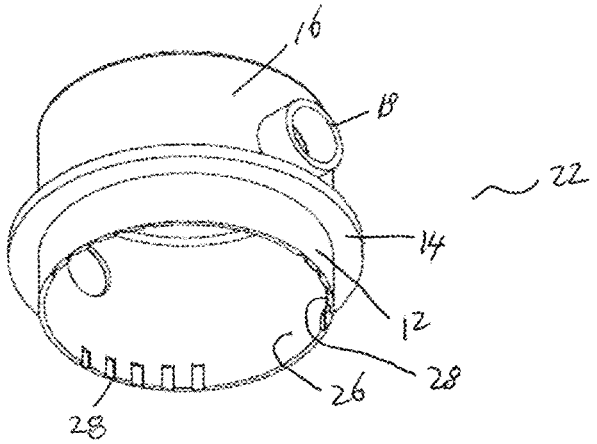
FIG. 7 shows a perspective view of an outer part of the arrangement shown in FIG. 1.

The insert 10 comprises an outer part 22 (shown in FIG. 7) and an inner part 24 (shown in FIG. 6). The outer part includes the lower cylindrical projection 12, the flange 14, the cylindrical body portion 16 and the tubular openings 18, 20. As can be seen from FIG. 7, the inner surface 26 of outer part 22 of insert 10 forms a generally cylindrical surface. A plurality of keyways 28 are formed to extend upwardly from the lower edge of outer part 22 of insert 10. The keyways 28 are formed in three groups that are spaced around the periphery of the lower edge of the outer part 22. Other arrangements may also be used.

Figure 8:
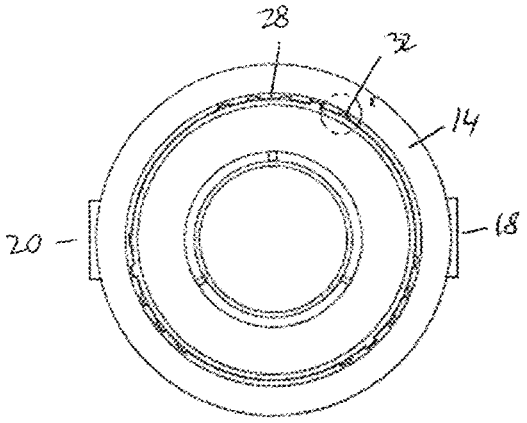
FIG. 8 shows a plan view, partly in cross-section, of the arrangement shown in FIG. 1.

The insert 10 also includes an inner part 24. Inner part 24 fits inside outer part 22 to form the insert 10. The inner part 24 has a cylindrical lower region 30. Spaced projections 32 are formed on the cylindrical lower region 30. Projections 32 are sized and positioned so that they can fit into the keyways 28 formed on the lower edge of the outer part 22 of the insert 10. In this manner, the outer part 22 and the inner part 24 can be keyed together so that they are retained in position relative to each other (see FIG. 8). Other arrangements to position the inner part 24 relative to the outer part 22 may also be used. Indeed, the inner part 24 and the outer part 22 could be permanently affixed to each other, such as by welding. As the cylindrical lower region 30 of inner part 24 comes into contact with the cylindrical inner surface 26 of the outer part 22 of the insert 10, a relatively sound seal can be achieved between the outer part 22 in the inner part 24. If desired, additional seals, such as O-rings or other seals, may be located between the inner part 24 and the outer part 22 of the insert 10.

The inner part 24 includes a central waisted region (see FIG. 6). The central waisted region includes an upper part 36 that extends inwardly from an upper periphery 38 and a part that extends downwardly and outwardly along region 40 (see FIG. 5). The transition from upper region 36 to region 40 occurs via a smoothly curved surface 42. In this manner, the inner part 24 of arrangement 10 forms a venturi or a Coanda surface that is defined by the inner surfaces of regions 36, 40 and 42.

Figure 5:
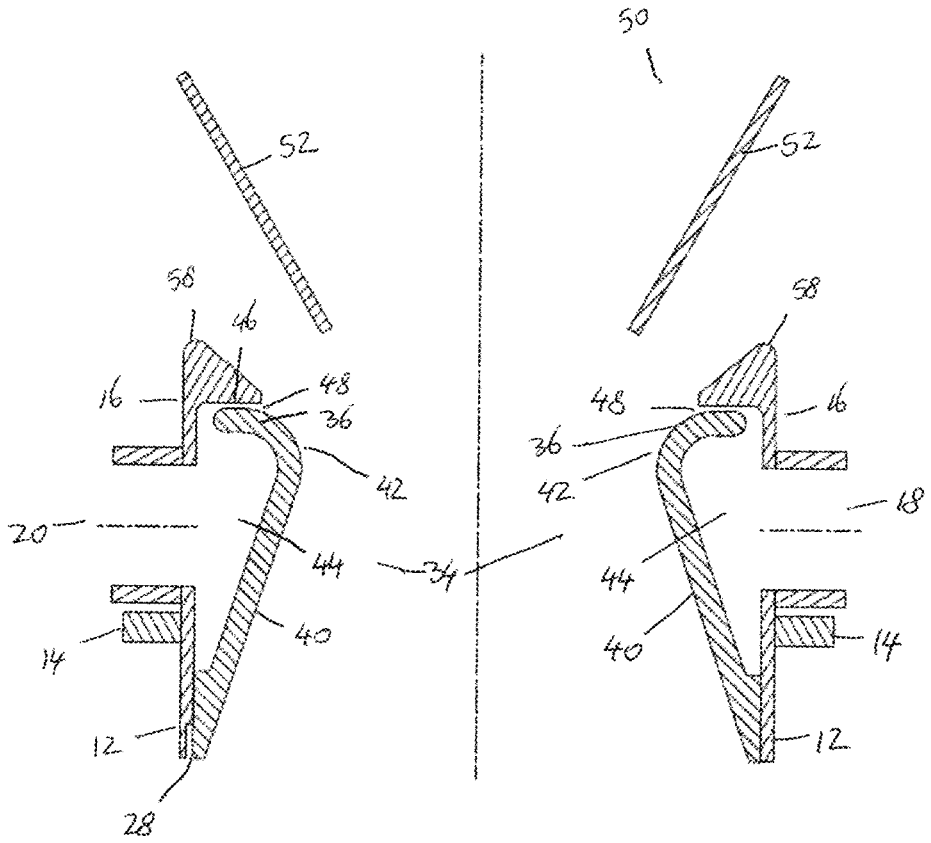
FIG. 5 shows a cross sectional view taken along section lines H-H shown in FIG. 4.

FIG. 5 shows a cross sectional view of the assembled insert 10. A plenum chamber 44 is defined between the outer surface of central waisted region 34 of the inner part 24 and the inner surface of cylindrical body portion 16 of outer part 22. As can be seen from FIG. 5, the upper periphery 38 (FIG. 6) of inner part 24 is spaced from an inwardly directed surface 46 of outer part 22. The space that is defined between forms an open annular passage 48. Open annular passage 48 is in fluid communication with the plenum chamber 44 which, in turn, is in fluid communication with a source of compressed gas via tubular openings 18, 20.

In use of the arrangement 10, pressurised gas is provided via tubular openings 18, 20 to the plenum chamber 44. The compressed gas exits the plenum chamber 44 via the open annular passage 48. Due to the shape of the inner surface of the inner part 24, the gas flowing out of the open annular passage 48 tends to follow the inner surface of the inner part 22, which causes the gas flowing out of the open annular passage 48 to flow downwardly and into the furnace. This also acts to entrain gas from an environment external to the furnace, which results in a total flow of gas into the furnace that is significantly higher than the flow of gas arising from the gas leaving the open annular passage 48. The total flow of gas into the furnace is sufficient to prevent gas from the furnace exiting through the feed opening of the furnace. In the embodiment shown in the attached drawings, the external gas that is entrained from the external environment largely or completely passes through the gap that exists between the external surface of the frusto conical body 52 of the chute 50 and the upper part of the insert that extends inwardly and downwardly from the upper periphery 58 of the insert.

It will be appreciated that the gas that flows into the furnace through the feed opening will ultimately exit the furnace through the exhaust opening of the furnace.

In order to enable feed materials to be fed to the furnace whilst minimising the risk that the feed materials will block the open annular passage 48, the arrangement 10 may also be provided with a feed chute 50. Feed chute 50 comprises a frusto conical hollow body 52 having a plurality of support feet 54 mounted thereto. Support feet 54 include recesses 56 that are shaped to snugly fit onto the upper periphery 58 of the outer part 22 of insert 10. In other embodiments, the feed chute may be permanently joined to the insert. In another embodiment, the feed chute may be omitted.

Figure 9:
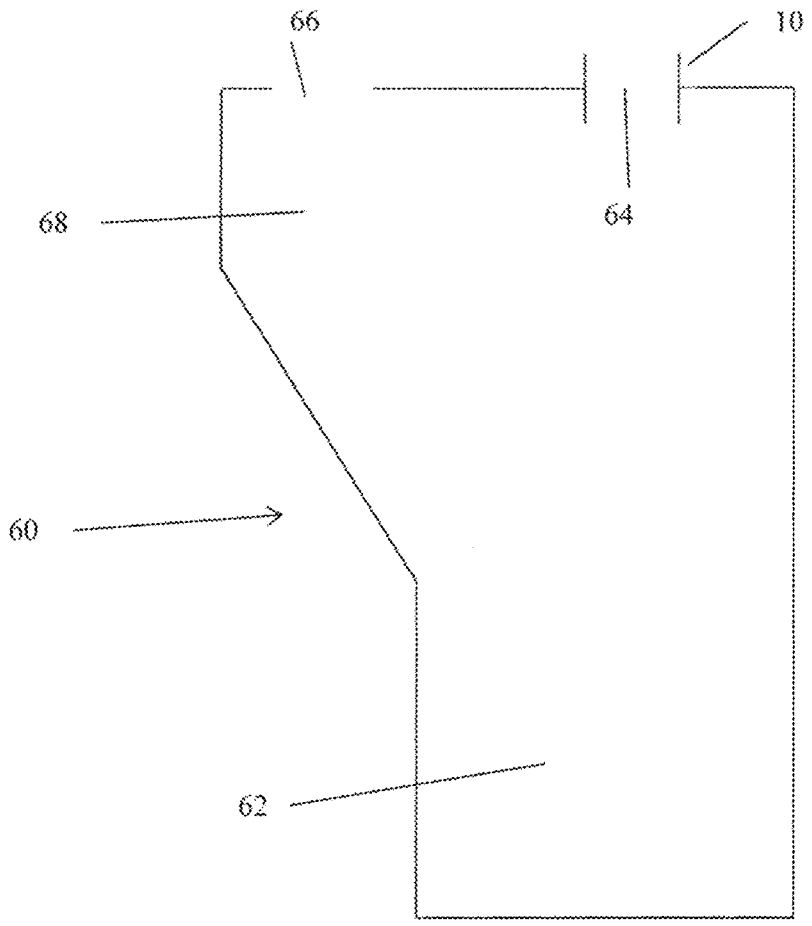
FIG. 9 shows a schematic view of the arrangement shown in FIG. 1 being mounted to a feed opening of a top entry submerged lance furnace.

FIG. 9 shows a schematic cross-sectional view of a top entry submerged lance furnace 60. The furnace 60 includes a lower portion 62 that contains a bath of molten material. The top of the furnace includes a feed opening 64 and an exhaust opening 66. Exhaust gases are removed from the furnace through exhaust opening 66. Exhaust opening 66 is located in a part of an exhaust region 68 of the furnace. The insert 10 is inserted into the feed opening 64. Once inserted, the insert 10 effectively forms the feed opening to the furnace.

Figure 10:
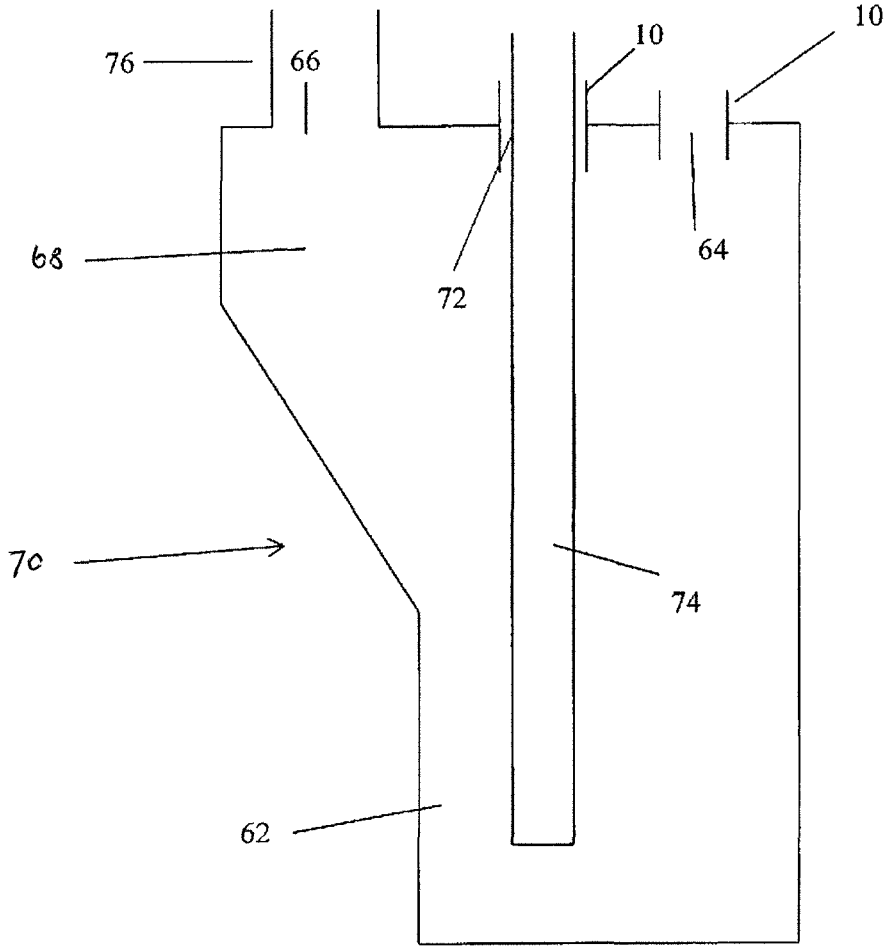
FIG. 10 shows a schematic view of one arrangement as shown in FIG. 1 being mounted to a feed opening of a top entry submerged lance furnace and another arrangement as shown in FIG. 1 being mounted to a lance opening of the furnace.

FIG. 10 shows a schematic cross-sectional view of another top entry submerged lance furnace. The furnace 70 shown in in FIG. 10 has a number of features that are in common with the furnace 60 shown in FIG. 9 and, for convenience, like features are denoted by the same reference numerals as used in FIG. 10. Where the furnace 70 of FIG. 10 differs from the furnace 60 of FIG. 9 is that the furnace 70 of FIG. 10 includes a lance opening 72 having a lance 74 extending therethrough into the furnace. Thus, the roof of the furnace 70 that is located away from the exhaust region of the furnace is provided with two separate openings, being the feed opening 64 and the lance opening 72.

Feed opening 64 is fitted with an arrangement 10 in accordance with the present invention to prevent egress of furnace contents from the feed opening 64. Similarly, lance opening 74 is also fitted with an arrangement 10 in accordance with the present invention to prevent egress of furnace contents from the lance opening 74. In this regard, the arrangement 10 is effective to prevent egress of furnace contents from the lance opening 72 even when the lance 74 extends through the lance opening 72. It will be appreciated that exhaust gas is removed from the furnace through exhaust opening 66, which causes the exhaust gas to flow into exhaust ducting/piping 76 to thereby remove the exhaust gas from the furnace. The exhaust ducting/piping may be provided with conventional exhaust gas cleaning systems, the nature of which will be well understood by persons skilled in the art.

Figure 11:
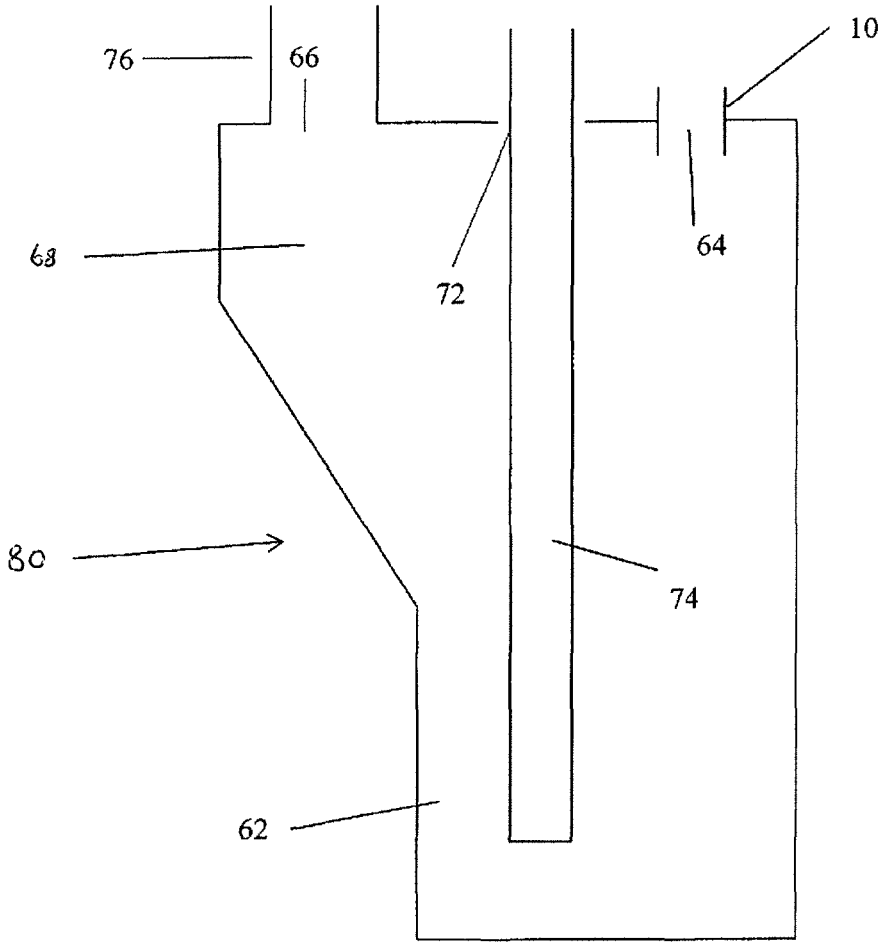
FIG. 11 shows a schematic view of one arrangement as shown in FIG. 1 being mounted to a feed opening of a top entry submerged lance furnace and a lance opening of the furnace being provided with a conventional extraction system.

FIG. 11 shows a schematic cross-sectional view of another top entry submerged lance furnace. The furnace 80 shown in FIG. 11 is very similar to the furnace 70 shown in FIG. 10 in that it includes a feed opening 64 and a lance opening 72. Other features that are common between the furnace 80 of FIG. 11 in the furnace 70 of FIG. 10 are denoted by like reference numerals. Where the furnace 80 of FIG. 11 differs from the furnace of FIG. 10 is that it is only the feed opening 64 of the furnace 80 that is fitted with an arrangement 10 in accordance with the present invention. The lance opening 72 of the furnace 80 is simply provided with conventional extraction systems (not shown) so that any dust or furnace contents exiting the furnace through lance opening 72 are captured by the extraction systems and removed from the immediate location of the furnace. It will be appreciated that egress of dust or other furnace contents through feed opening 64 is prevented by operation of the arrangement 10 in accordance with the present invention. The exhaust opening 66 is connected to exhaust ducting/piping 76 to thereby remove exhaust gas from the furnace.

Figure 12:
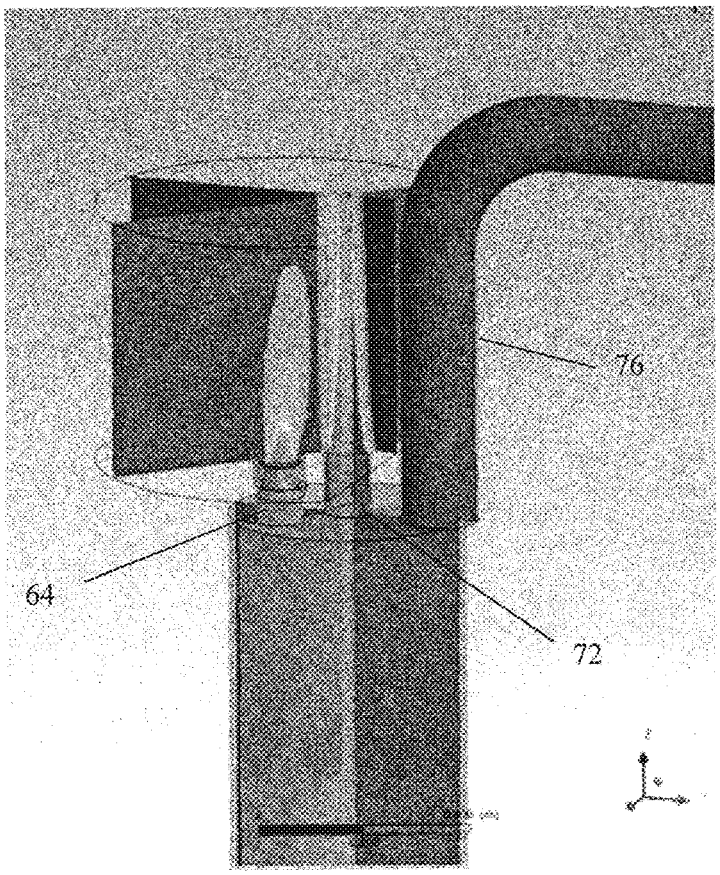
FIG. 12 shows the results of modelling conducted on a top entry submerged lance furnace that is essentially similar to the furnace shown in FIG. 10, but with the arrangements 10 fitted to the feed opening and lance opening not being in operation.

FIG. 12 shows the results of modelling conducted on a top entry submerged lance furnace that is essentially similar to the furnace 70 shown in FIG. 10. The furnace shown in FIG. 12 has a feed opening 64 and a lance opening 72. Exhaust piping 76 is also shown. The feed opening 64 and the lance opening 72 are both provided with an arrangement 10 in accordance with the present invention for preventing or minimising egress of furnace contents therefrom. The modelling shown in FIG. 12 shows gas flows when no flow of air is provided to the arrangements 10 fitted into feed opening 64 and lance opening 72. As can be shown from FIG. 12, significant plumes of gas exit the furnace from both the feed opening 64 and the lance opening 72.

Figure 13:
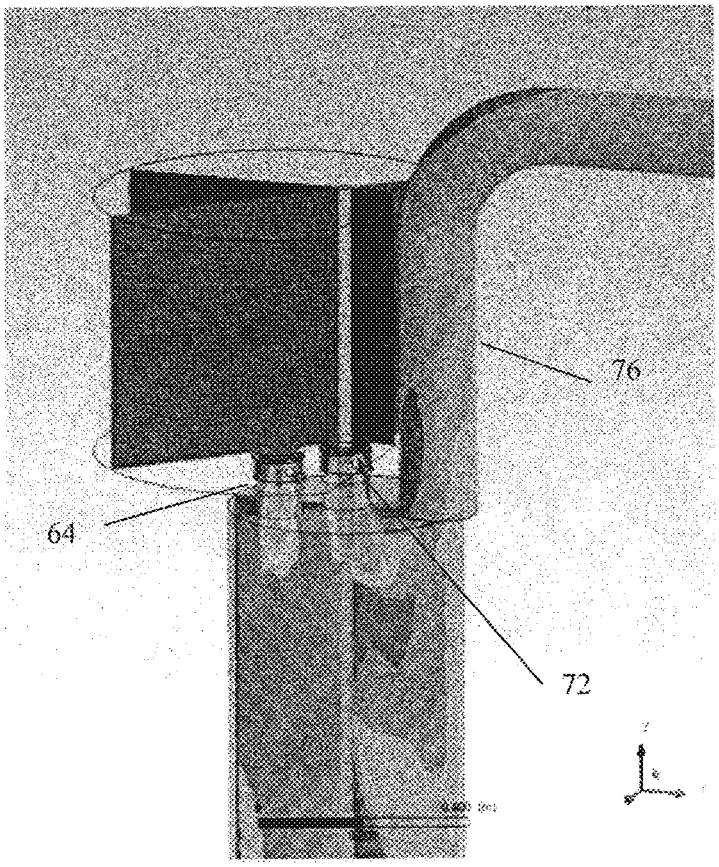
FIG. 13 shows the results of modelling conducted on the top entry submerged lance furnace shown in FIG. 12, but with the arrangements 10 fitted to the feed opening and lance opening being in operation.

FIG. 13 shows modelling of the furnace shown in FIG. 12 but with the devices 10 fitted to the feed opening 64 and the lance opening 72, respectively, both being turned on so that air is flowing out of the respective passageways extending around the feed opening 64 and the lance opening 72 and into the furnace. As can be seen from FIG. 13, there is a significant inward flow of gas into the furnace through both the feed opening 64 and the lance opening 72. The modelling shows that there is no egress of furnace contents through the feed opening 64 and the lance opening 72 when the devices 10 in the feed opening 64 and the lance opening 72 are operating. The only gas exiting the furnace is exiting through the exhaust piping 76. Thus, operation of the arrangements 10 in accordance with the present invention has prevented egress of furnace contents through the feed opening 64 and lance opening 72.

As shown in FIGS. 12 and 13, the present inventors have conducted CFD modelling of a top entry submerged lance furnace having an insert 10 present in the feed opening thereof. Absent the insert 10, or when the insert 10 is not operating, that modelling shows that some of the gaseous contents of the furnace were emitted through the feed opening of the furnace. As the gaseous contents of the furnace may include corrosive gases or toxic gases, it is undesirable that these gases be emitted through the feed opening, as operating personnel may be required to be in close physical proximity to the feed opening. The computer modelling conducted by the present inventors has shown that placing the insert 10 in the feed opening and operating the insert 10 can prevent the egress of furnace gases from the furnace via the feed opening.

The skilled person will appreciate that the total flow of gas into the furnace through the feed opening can be controlled by controlling the flow rate of gas leaving the annular passage in the insert. The flow rate of gas may be controlled by controlling the pressure of the gas that is provided to the plenum chamber.

The amount of gas required to flow in through the feed opening to prevent furnace gases from leaving via the feed opening can also be controlled by controlling the furnace pressure and/or controlling the flow rate of furnace gas leaving through the exhaust opening.

The gas that is supplied to the plenum chamber may comprise air. Alternatively the gas that is supplied to the plenum chamber may comprise recycled furnace gas, recycled air, heated air, or even one or more gases required to promote reactions within the furnace. Gases that may take part in reactions within the furnace include oxygen, carbon monoxide, natural gas, other fuel gases or the like.

The temperature of the gas supplied to the plenum chamber may be controlled to ensure that temperature conditions within the furnace are not unduly upset.

The embodiment shown in the attached drawings includes two diametrically opposed tubular inlets into the plenum chamber. It will be appreciated that a different number of inlets to the plenum chamber may be used to provide pressurised gas to the plenum chamber. For example, for larger diameter inserts, more than two openings into the plenum chamber may be provided. Ideally, the plurality of openings to the plenum chamber will be equi-spaced around the periphery of the plenum chamber.

The opening 48 through which the pressurised gas flows from the plenum chamber should be sized sufficiently large such that it is unlikely to be blocked by stray particulate material that is being fed to the furnace whilst also being small enough to ensure that a high gas velocity is obtained in the gas leaving that passage.

The present invention has industrial applicability in respect of any vessel that has a first opening and at least one other opening. It will be appreciated that the gas that is injected into the vessel via the first opening must leave the vessel via another opening in order to enable the present invention to successfully operate.

Without wishing to be bound by theory, the present inventors believe that the present invention takes advantage of the Coanda effect. The Coanda effect is the tendency of a jet of fluid, such as a jet of gas, to be attracted to and to flow along a nearby surface. By passing pressurised gas through the open annular passage, the pressurised gas leaving the annular passage tends to follow the surface of the waisted portion of the inner part of the insert. The waisted portion forms a Coanda surface (which has several characteristics of a venturi) and the pressurised gas leaving the open annular passageway flows inwardly and then downwardly and along the inner surface of the waisted portion. This establishes an inwardly directed flow of gas that has a relatively high speed at a relatively low flow rate (that is, a relatively low volumetric flow rate). This causes external gas to also be drawn into the waisted portion of the insert and thereafter into the furnace. The total flow of gas through the insert into the furnace effectively forms an air curtain that acts to prevent furnace gases from flowing out through the feed opening.

The arrangement shown in the attached drawings may be retrofitted to existing furnaces. The arrangement includes the outer part 22 and the inner part 24. In other embodiments, the outer part 22 and the inner part 24 may be permanently joined together, such as by welding. However, the arrangement shown the attached drawings is advantageous in that the outer part 22 and the inner part 24 may be removed from the furnace and separated from each other for cleaning or for clearing blockages. It will also be appreciated that a similar arrangement may be constructed as part of the feed opening of the furnace rather than being provided as a retrofit insert.

Although the preferred embodiment of the present invention has been described with reference to its use in conjunction with a feed opening of a top entry submerged lance furnace, it will be appreciated that the present invention may be used in any application where a vessel is provided with two or more openings and it is desired to prevent flow of gas from the vessel out through one of those openings. The present invention may be used in other types of furnaces, in high-temperature vessels, in storage vessels, such as storage silos for granular material or particulate, and the like. The present invention can be used in any application where it is desired to prevent the egress of gas, dust or fine particulate material from an opening of a vessel.

The present invention is also suitable for use with vessels where the feed material is fed to the vessel through the first opening in a continuous manner. In applications where the material is fed to the vessel in an intermittent manner, it may be possible to increase the flow of gas through the open passage when no feed material is being fed to the vessel in order to entrain sufficient gas from an external environment to prevent egress of gas through the first opening. Alternatively, it may possible to simply close off the first opening using a closure when no feed material is being fed to the vessel.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A method for preventing egress of gas from a first opening of a vessel, the vessel including at least one other opening through which gas can leave the vessel, the method comprising supplying a flow of gas to an open passage extending substantially around the first opening and causing the flow of gas leaving the open passage to flow towards and into the vessel whereby a gas from an environment external to the vessel is caused to be drawn into the vessel, wherein a total flow of gas into the first opening substantially prevents gas from leaving the vessel through the first opening.

2. An arrangement for preventing egress of a gas from a first opening of a vessel, the vessel including at least one other opening through which the gas can leave the vessel, the arrangement comprising an open passage extending substantially around the first opening, the open passage receiving a flow of gas such that the flow of gas leaves the open passage and flows towards and into the vessel to cause a gas from the environment external to the vessel to be drawn into the vessel.

3. The arrangement as claimed in claim 2 wherein the open passage extends around the first opening.

4. The arrangement as claimed in claim 2 wherein the first opening comprises a generally circular opening.

5. The arrangement as claimed in claim 4 wherein the open passage comprises an annular open passage extending around the first opening.

6. The arrangement as claimed in claim 2 wherein the open passage extends around an inner surface of the first opening.

7. The arrangement as claimed in claim 2 wherein the surface of the first opening between the open passage and the vessel is shaped to promote the flow of gas leaving the open passage to flow towards and into the vessel.

8. The arrangement as claimed in claim 7 wherein the surface of the first opening between the open passage and the vessel have a shape, when moving in a direction towards the vessel, that extends inwardly towards the centre of the first opening and then outwardly away from the centre of the first opening.

9. The arrangement as claimed in claim 2 wherein the surface of the first opening between the open passage and the vessel forms a venturi.

10. The arrangement for preventing egress of a gas from a first opening of a vessel as claimed in claim 2 wherein the surface of the first opening between the open passage and the vessel comprises a Coanda surface.

11. The arrangement as claimed in claim 10 wherein the plenum chamber receives pressurised gas and the pressurised gas flows from the plenum chamber through the open passage and into the vessel.

12. The arrangement as claimed in claim 10 wherein the plenum chamber has at least one, preferably two or more, inlets for receiving pressurised gas.

13. The arrangement as claimed claim 12 wherein the plenum chamber has two or more inlets for receiving pressurised gas and the two or more inlets are equi-spaced around the plenum chamber.

14. The arrangement as claimed in claim 2 wherein the open passage is in fluid communication with a plenum chamber.

15. The arrangement as claimed in claim 14 wherein the plenum chamber extends around the first opening.

16. The arrangement as claimed in claim 2 wherein the arrangement further comprises a feed chute for feeding material to the vessel.

17. The arrangement as claimed in claim 2 wherein the arrangement of the present invention comprises an insert that is inserted into the first opening of the vessel and when the insert is inserted into the first opening, the inner surface of the insert effectively defines the first opening of the furnace.

18. The arrangement as claimed in claim 17 wherein the insert includes a portion extending into the first opening of the vessel and another portion that defines the open passage extending around an inner periphery of the insert.

19. The arrangement as claimed claim 18, wherein the insert also defines the plenum chamber and at least one inlet for receiving pressurised gas.

20. The arrangement as claimed in claim 17 wherein the insert comprises a flange that comes into contact with an outer surface around the first opening of the vessel to thereby position the insert relative to the first opening of the vessel.

* * * * *